United States Patent [19]

Link

[11] Patent Number: 4,550,790

[45] Date of Patent: Nov. 5, 1985

[54] DIAMOND ROTATING BIT

[75] Inventor: Howard D. Link, Salt Lake City, Utah

[73] Assignee: Norton Christensen, Inc., Salt Lake City, Utah

[21] Appl. No.: 470,507

[22] Filed: Feb. 28, 1983

[51] Int. Cl.[4] ..... E21B 10/46; E21B 10/60

[52] U.S. Cl. ..... 175/329; 175/393; 76/108 A

[58] Field of Search ..... 175/329, 330, 410, 393, 175/329, 422; 76/108 A

[56] References Cited

U.S. PATENT DOCUMENTS

| | | | |
|---|---|---|---|
| 3,027,952 | 4/1962 | Brooks | 175/329 |
| 3,599,736 | 8/1971 | Thompson | 175/329 |
| 3,640,356 | 2/1972 | Feenstra | 175/329 |
| 3,696,875 | 10/1972 | Cortes | 175/410 |
| 3,698,491 | 10/1972 | Hoffman | 175/329 |
| 3,709,308 | 1/1973 | Rowley | 175/329 |
| 4,176,723 | 12/1979 | Avceneaux | 175/329 |
| 4,341,273 | 7/1982 | Walker | 175/293 |
| 4,373,593 | 2/1983 | Phaal et al. | 175/410 |

OTHER PUBLICATIONS

Geoset Drill Diamond Sales Brochure, General Electric, received 10-18-1982.

*Primary Examiner*—Stephen J. Novosad

*Attorney, Agent, or Firm*—Beehler, Pavitt, Siegemund, Jagger & Martella

[57] ABSTRACT

An improved rotating diamond bit for earth boring is devised by incorporating generally triangular, prismatically shaped synthetic polycrystalline diamond elements in the teeth of the boring bit. The polycrystalline diamond elements are set on lands defined on the bit face such that two opposing triangular faces of the prismatic diamond element form a dihedral angle in the direction of travel of the element defined by the bit rotation. The polycrystalline diamond element is thus inclined with respect to the direction of linear travel of the element when the bit rotates. In other words, the normal to the parallel opposing triangular faces of the diamond element is acutely inclined with respect to the direction of travel of the element. A shoulder-to-gage transition pattern of the junk slot, waterway and collector is arranged to uniformly distribute the flow of fluid across the shoulder to guage transition. Further, the distribution of fluid from the central conduit within the longitudinal core of the bit to a plurality of nozzles which merge with corresponding waterways on the bit face is arranged such that fluid is preferentially delivered to a radially innermost nozzle and thereafter in a graduated series of steps in lesser amounts to a series of sequenced nozzles more radially disposed from the center of the rotating bit.

15 Claims, 8 Drawing Figures

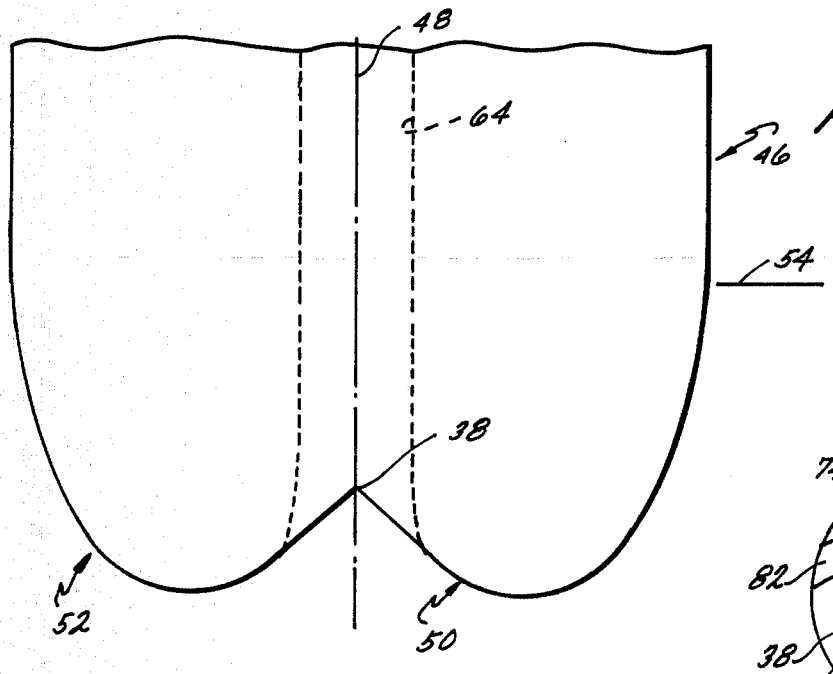
Fig. 4
Fig. 5
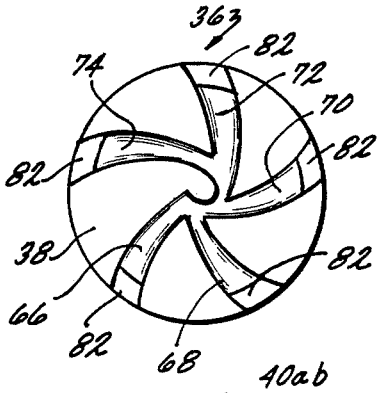
Fig. 6
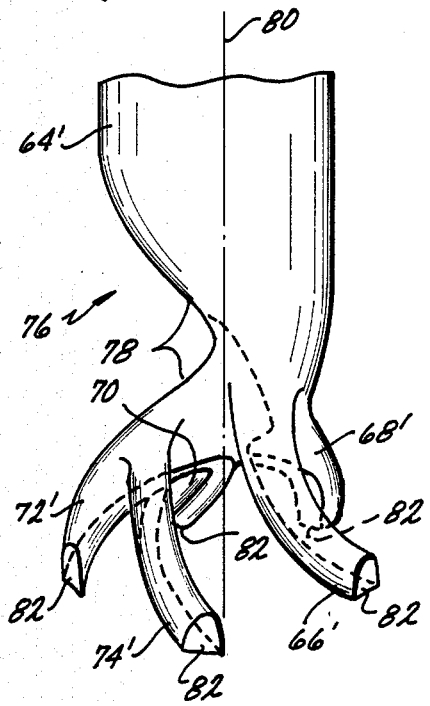
Fig. 7
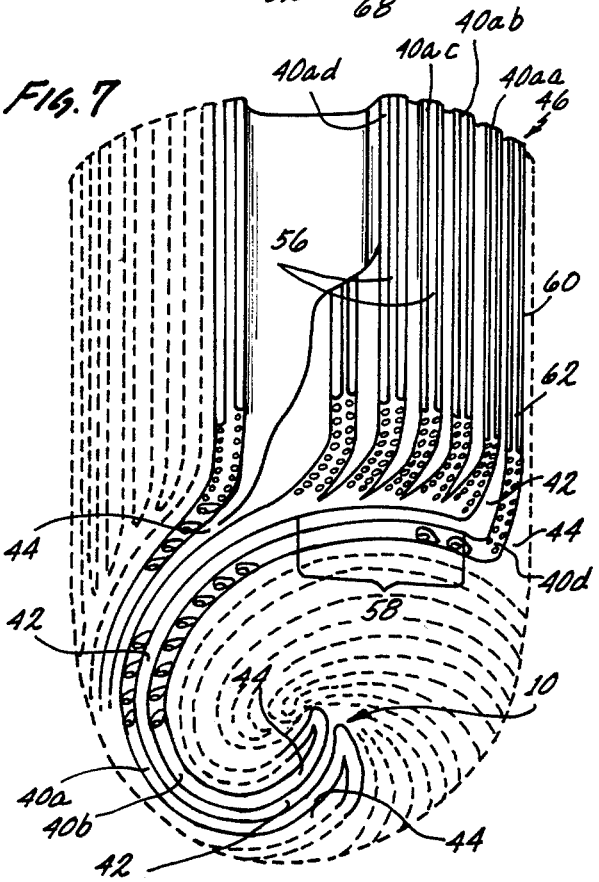

DIAMOND ROTATING BIT

BACKGROUND OF INVENTION

1. Field of the Invention

The present invention relates to the field of earth boring bits and more particularly to such bits as embodied in rotating bits incorporating diamond cutting elements.

2. Description of the Prior Art

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Cyrstalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual compact elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products. However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal matrix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD compact be surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degree of exposure for such a diamond. In the case of abrasive rock, it is suggested by the prior art that the triangular element be set completely below the metal matrix. For soft nonabrasive rock, it is suggested by the prior art that the triangular element be set in a radial orientation with the base at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after sufficient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drill rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is usuable in specific formations without the necessity of significantly increased drill string weight, bit torque, or significant increases in drilling fluid flow or pressure, and which will drill at a higher ROP than conventional fits under the same drilling conditions.

BRIEF SUMMARY OF THE INVENTION

The present invention is an improvement in a rotary bit having a bit face and center. The rotary bit includes a plurality of polycrystalline diamond elements which are disposed in or on and extend from the bit face. Each element has a generally triangular prismatic shape which is characterized by two parallel triangular opposing end surfaces and planar side surfaces connecting the two end surfaces. The improvement comprises the disposition of each element on the bit face at an angle with respect to the direction of movement of each element when the bit is rotated about its center. The angle of disposition is particularly characterized by an acute angle of inclination of the normal of the end faces with respect to the direction of movement. Since the normal to the end faces is neither in line with nor perpendicular to the direction of movement of the triangular prismatic polycrystalline diamond element, one end surface and side surface of the element form a dihedrally shaped leading compound surface which is employed for cutting and acts as a plow.

The invention is further characterized by disposing each such polycrystalline diamond element on a land defined on the rotary bit face with adjacent waterways such that the normal to the end faces of the element is approximately perpendicular to the land at that point where the element is disposed. By virtue of this disposition, the end faces of the element are essentially tangential to the adjacent waterways thereby improving the cleaning and removal action of fluid moving through the waterways.

The improvements are further characterized by a particular transition at the shoulder of the rotary bit between a waterway defined in the bit face and a plurality of collectors defined in said rotary bit face beginning at the transition and continuing along the gage of the rotary bit. More particularly, a waterway is defined on the bit face to extend to the peripheral portion of the bit face near the shoulder-to-gage transition of the bit face, and then extends to form a substantially longitudinal waterway or must continue the spiral around the vertical portion, on the gage of the rotary bit. Adjacent to the extension of the waterway through the transition at the periphery of the bit and through the gage, a plurality of collectors are defined in the transition and gage, which collectors lead up to the waterway at or near the transition and are separated from the waterway by an unbroken land whereby pressure of the fluid moving through the waterway moves in part over the unbroken land into the adjacent collectors to provide an even distribution of flow across the transition of the bit face and across the gage of the bit.

The improvement also includes an internal longitudinal manifold axially defined in the rotary bit for delivery of fluid to the face of the rotary bit wherein the manifold terminates in a plurality of nozzles in a preferential sequence whereby fluid is delivered through the plurality of nozzles in a corresponding preferential sequence, namely, a first nozzle delivering a maximal amount of fluid to the bit face, a second nozzle delivering a lesser amount of fluid than the first nozzle, a third nozzle delivering a still lesser amount of fluid than the second nozzle and so forth. The first nozzle is generally closer to the center of the rotary bit than the second. The second nozzle is generally located closer to the center of the rotary bit than the third and so forth. By reason of this arrangement, a maximal amount of fluid is delivered to the rotary bit near its center with a graduated distribution of lesser amounts of fluid being delivered to the bit face at radial positions on the bit face at increasing distances from the center of the bit.

These and other advantages and embodiments of the present invention are best understood by considering the following Figures.

BRIEF DESCRIPTION OF THE DRAWINGS

FIG. 4 is a cross sectional view taken through line 4—4 FIG. 3.

FIG. 5 is a diagrammatic plan view of the mandrel of FIG. 6 illustrating the nozzles defined in the bit face.

FIG. 6 is a mandril for shaping the central hydraulic manifold and the nozzles of the bit of FIG. 3.

FIG. 7 is a perspective view of the bit of FIG. 3, particularly illustrating the shoulder-to-gage transition.

DETAILED DESCRIPTION OF THE PREFERRED EMBODIMENTS

The present invention is an improved rotary bit incorporating an improved shaped tooth using triangular prismative synthetic polycrystalline diamonds wherein each triangular prismatic diamond element disposed within each tooth is inclined with respect to its direction of travel as defined by rotation of the bit upon which the tooth is formed, which inclination presents one of the edges defined by a triangular end surface and planar side surface of the triangular prismatic diamond element as the leading edge of the diamond element. When thusly oriented, the opposing triangular faces of the diamond element are positioned so as to be substantially parallel to the adjacent segments of a channel on each side of the tooth so that chips are cleanly washed away from the tooth faces as defined by the crystalline diamond element. Furthermore, the rotary bit is improved by a preferential distribution of hydraulic fluid through the nozzles with most of the fluid being delivered by the innermost nozzle and with lessening amounts of fluid being delivered to radially more distant nozzles. Still further, the rotary bit of the present invention is improved by an arrangement of the waterways and collectors at the shoulder-to-gage transition of the rotary bit such that the pressure across the peripheral shoulder-to-gage transition is substantially equalized.

The present invention and its various embodiments can be better visualized by considering the following description in light of the Figures described above.

Figure 1:
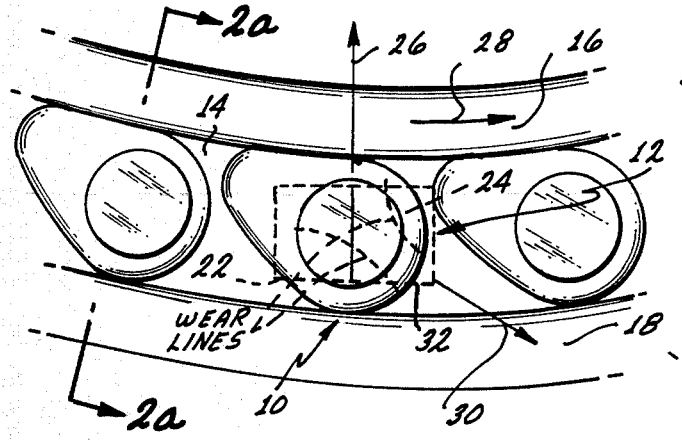
FIG. 1 is a plan view of a tooth on a diamond rotary bit improved according to the present invention.

Turning now to FIG. 1, a plan view of a single tooth, generally denoted by reference numeral 10, is illustrated in which a generally triangular prismatic polycrystalline diamond element, generally denoted by reference numeral 12, has been embedded. Tooth 10 is disposed on a land 14 on the bit face of the rotary bit, which land 14 is defined by and is adjacent to two channels 16 and 18. In the presently illustrated embodiment, channel 16 is a waterway and will hereinafter be referred to as waterway 16 while channel 18 is a collector and will hereinafter be referred to as collector 18. The waterways and collectors alternate across any radius so that the next row of teeth will have the waterway and collector interchanged from that shown in FIGS. 1 and 2. As will be shown in more detail in connection with a specific embodiment of a petroleum bit described in relation to FIGS. 3–7, the tooth of FIGS. 1 and 2 are characterised by being positioned on lands 14 between waterways 16 and collector 18 in a rotary bit including an alternating series of waterways and collectors which are spirally formed to define lands 14 therebetween with a plurality of teeth of the type shown as tooth 10 in FIG. 1 disposed in or on and projecting from land 14.

Tooth 10 has embedded therein a triangular prismatic polycrystalline diamond element 12 which may also extend below land 14 and be further embedded within land 14 or the underlying matrix material 20 of the rotary bit as best illustrated in FIG. 2. It is also included within the scope of the present invention that element 12 may have its lowermost surface substantially flush or even with the uppermost surface of land 14 and thereby being substantially or totally embedded only within tooth 10. In any case, element 12 is particularly characterised by having two opposing parallel triangular surfaces 22, only one of which is shown in dotted outline in FIG. 2, which surfaces 22 are connected by planar side surfaces 24. In the illustrated embodiment, polycrystalline diamond elements 12 are conventional synthetic diamonds manufactured by General Electric Company under the trademarks 2102 or 2103. In this case, the triangular opposing surfaces 22 are equilateral triangular surfaces which in the case of a 2102 type element measure approximately 4 millimeters on a side with a thickness of 2.6 millimeters.

Referring again to FIG. 1, the orientation of element 12 on land 14 and on the bit face of the rotary bit in which land 14 is formed, is geometrically characterised by the diagonal disposition of each element 12 together with its surrounding matrix material on land 14. As illustrated in FIG. 1, portion 26 of tooth 12 lies diagonally across land 14 and in the direction 30 of travel of tooth 14. Thus, portion 26 provides tangential trailing support for element 12 while permitting maximum packing and density of teeth 10 and elements 12 on the spiral lands. Near the center where the spiral is tight, portions 26 lie across the land 14 at a sharp diagonal angle. The diagonal angle approaches a tangent as the spiral flattens and begins to assume the curvature of a circle. The spirals may be leading or trailing, i.e. spiralling in the opposite or same sense of rotation as the normal rotation of the bit respectively. When a leading spiral is used, fluid flow in the waterway is in a direction against the direction of rotation which tends to aggressively wash chips up and away from the bit face. When a trailing spiral is used, fluid flow tends to be more streamlined and confined within the waterways thereby keeping chips down in the channels.

In the preferred embodiment, teeth 10 are disposed on lands 40 of the bit face such that at least one end surface 22 is adjacent or substantially adjacent to the edge of land 40. This close proximity to the adjacent waterway or collector enhances the effectiveness of the cleansing of tooth 10 by the adjacently flowing fluid. Because of the spiral lay of land 40, essentially the entire longitudinal mass and volume of land 40 is available for structural support of diamond element 12 against the cutting forces to which it is subjected despite its adjacent proximity to waterway 16 and collector 18.

However, the linear direction of motion of tooth 10 and element 12 as defined by the rotation of the rotary bit about its center is in the direction indicated by arrow 30 in FIG. 1. Thus, neither end surfaces 22 nor side surfaces 24 of element 12 are presented in a perpendicular orientation to direction of travel 30. Instead, element 12 is acutely inclined with respect to the direction of travel, or more specifically normal 26 is oriented at an acute angle with respect to direction 30. As a result, one side surface 24 and one end surface 22 form a dihedral angle which is forwardly presented and forms a cutting wedge as tooth 10 moves in direction 30, perhaps better illustrated in FIG. 2*a*. Edge 32, defined by the intersection of side surface 24 and end surface 22, thus forms the leading and cutting edge of element 12, which serves to act as a plow.

Figure 2A:
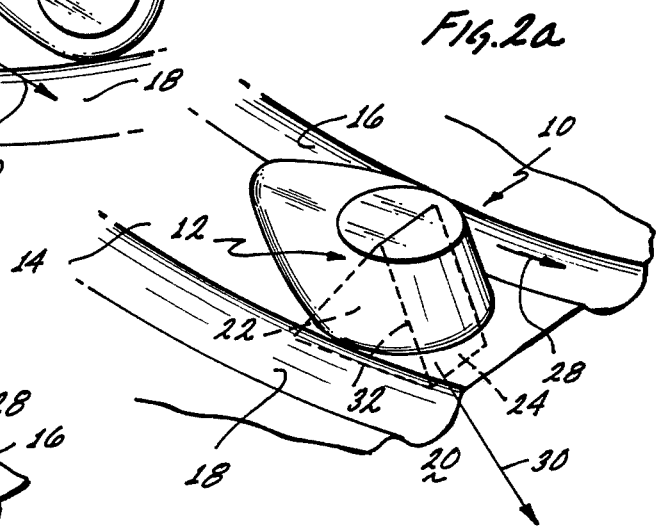
FIG. 2*a* is a partial perspective view taken through line 2*a*—2*a* of FIG. 1 lying along a radius of the bit.
Figure 2B:
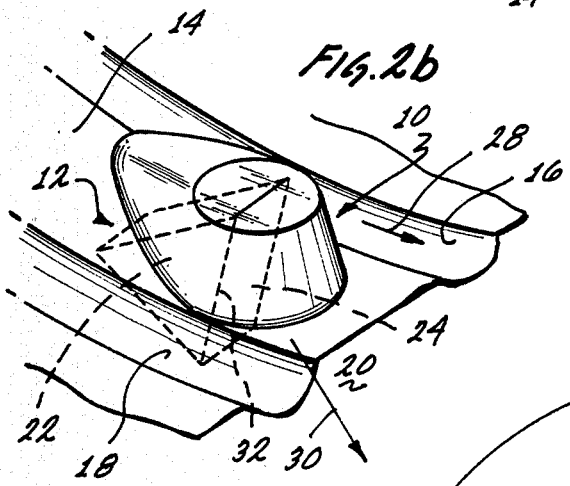
FIG. 2*b* is the same partial perspective view of FIG. 2*a* except that PCD elemeent 12 is forwardly inclined to provide a positive rake as opposed to the negative rake shown in FIG. 2*a*.

FIG. 2*a* shows an embodiment wherein PCD element 12 is approximately perpendicular to the surface of land 14 so that front side surface 24 provides a negative rake, sloping away from the direction of attack. FIG. 2*b* illustrates another embodiment wherein PCD element 12 is forwardly inclined within tooth 10 so that front side surfaces 24 provide a positive rake, leading into the direction of attack.

Figure 3:
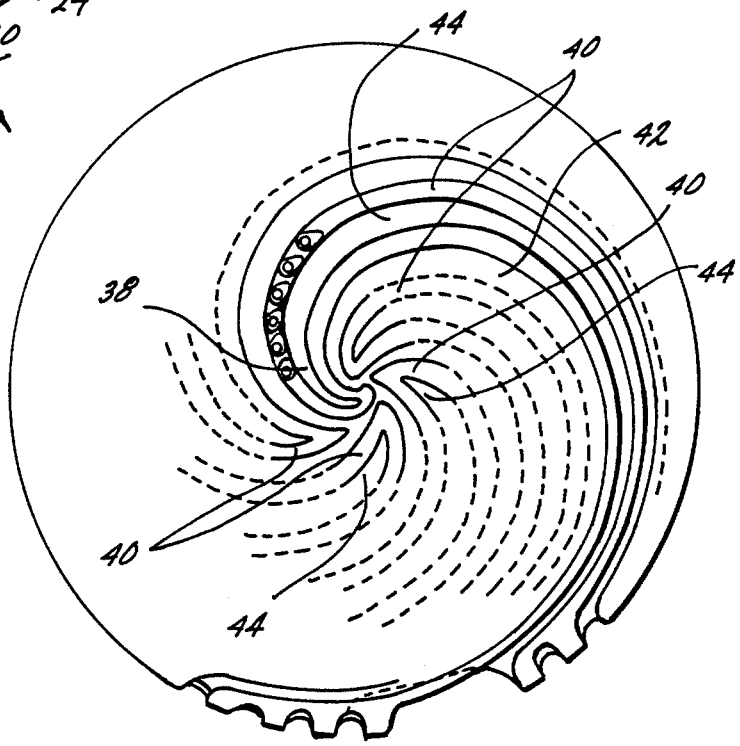
FIG. 3 is a diagrammatic plan view of a rotary petroleum bit improved according to the present invention.

Turning now to FIG. 3, the tooth of FIGS. 1 and 2*a,b* are shown integrally formed in a petroleum rotary bit, generally denoted by reference numeral 36, which is improved according to the present invention. Bit 36 has formed about its center 38 five pairs of spirally shaped lands wherein each pair of lands 40 is separated by a waterway 42. The arms of each pair of lands 40 are in turn separated by a collector 44. Lands 40 spiral outwardly from center 38 in a clockwise direction until they reach the circumferential periphery of bit 36 or gage 46. as stated above, lands 40 could also spiral outwardly in a counterclockwise sense as well. Referring to FIG. 4, which shows a cross sectional view of bit 36 taken from the longitudinal axis 48, the bit face extends from center 38 to a nose portion, generally denoted by reference numeral 50, and thence outward radially to a shoulder portion 52, ultimately transitioning into gage 46. Teeth 10 as described in connection with FIGS. 1 and 2*a,b* are disposed on lands 40 up to gage 46 where teeth 10 are replaced by conventional natural diamond teeth, namely gage kickers 62. Cutting is performed by teeth 10 while kickers 62 principally keep the drilled bore "in gage" and remove little material.

As can be better seen by the partial perspective view of FIG. 7, two adjacent pairs of lands 40, namely, land 40*a* and land 40*b* are defined and separated from each other by waterway 42. Waterway 42 spirals outwardly in a clockwise direction across nose 50, shoulder 52 and ultimately to the edge of gage 46. At the periphery of bit 36, at the top of gage 46 at level 54 as illustrated in FIG. 4, waterway 42 turns and runs longitudinally down the surface of gage 46 as better shown in FIG. 7.

Meanwhile adjacent land 40*a*, forming one leg of an adjacent pair of lands 40, also spirals outwardly in a clockwise direction across nose 50 and shoulder 52 until it also reaches level 54 of gage 46 thereby forming the opposing side of waterway 42. At level 54, land 40*a* extends into a plurality of lands longitudinally defined on the surface of gage 46 parallel to the longitudinal extension of land 40*b* also defined on the surface of gage 46. In the illustrated embodiment shown in FIG. 6, land 40*a* splits into five such longitudinal gage lands 40*aa* through 40*ac*. Each of the lands 40*aa*–40*ac* are defined and separated from each other by gage collectors 56 which extend longitudinally along gage 46 up to and near level 54 of gage 46 but do not penetrate through land 40*a*. Thus, portion 58 of land 40*a* serves as a partial barrier or dam which separates the uppermost portions of gage collectors 56 from waterway 42. As the fluid within waterway 42 reaches the periphery of the bit 36, the fluid will tend to flow in the direction of least resistance. If the first of the gage collectors 56 were connected through to waterway 42, this would provide a direct path of minimal resistance by which the fluid could exit waterway 42 and flow along gage 46. However, the partial damming action provided by portion 58 of land 40*a* serves to evenly distribute the hydraulic pressure among gage collectors 56 and the longitudinal extension of waterway 42 on gage 46. Thus the distance of separation provided between waterway 42 and the beginning of each one of collectors 56 provided by portion 58 of land 40*a* can be chosen according to the present invention to provide a graduated barrier or resistance between the respective gage collector 56 and waterway 42 to evenly distribute the hydraulic pressure across the shoulder-to-gage transition of bit 36. For example, it is also entirely within the scope of the present invention that the height of portion 58 of land 40*a* between each respective gage collector 56 and waterway 42 could also be varied in a graduated manner to evenly or controllably distribute hydraulic pressure across the shoulder-to-guage transition.

A collector 44 corresponding to each of lands 40*a* and 40*b* also spirally extends outward in a clockwise direction from the center of bit 36 to form a longitudinal junk slot 60 in gage 46 on each side of corresponding lands 40*a* and 40*b*. The dimensions of junk slots 60 are balanced with respect to the dimensions of gage collectors 56 and of waterway 42 on gage 46 to further balance the distribution of hydraulic pressure across the periphery of bit 36 and across gage 46. The pattern described above formed by two adjacent arms 40*a* and 40*b* of pairs of adjacent lands 40 forming the spiral pairs extending from the center of bit 36, is symmetrically and periodically repeated around the bit face to form five identical such patterns. Synthetic diamonds are used in teeth 10 as described in connection with FIGS. 1 and 2 and a plurality of sizes of natural diamonds are used as kickers 62 beginning with the larger sized natural diamonds next to teeth 10 and ending with the smaller sized natural diamonds on the cylindrical side of gage 46.

Thus, what has been described is a bit face configuration whereby the hydraulic pressure can be equally distributed about the bit face and particularly at the periphery and gage of bit 36 where the hydraulic fluid becomes most thinly distributed, where the pressure becomes the weakest and where the velocity of linear travel of the bit, teeth 10 and gage kickers 62 are maximal.

Turning now to FIGS. 5 and 6, consider the means by which an improved rotary bit of the present invention delivers hydraulic fluid to the center and across the bit face for even distribution across the nose, shoulder and gage as described above. Particularly consider FIG. 5 which is a diagrammatic plan view of a central portion of mandril 76 of FIG. 6. In the illustration of FIGS. 5 and 6 it is more convenient and clear if the description is of the mandril 76 used to form the nozzles of bit 36 than if an attempt was made to visualize the passages defined in bit 36 and its face. Therefore, FIGS. 5 and 6 represent the negative of the channels defined into bit 36. Mandril 76 is the form used in the molding process to form the central manifold and nozzles. The counterclockwise spiralled patterns illustrated then in FIGS. 5 and 6 results in the clockwise spiralled patterns of the bit shown in FIGS. 3, 4 and 7.

FIG. 5 diagrammatically illustrates the nozzles formed into the bit face. A single nozzle is provided for each waterway 42 and each nozzle is faired into its corresponding waterway in the manner suggested in FIG. 3. The nozzles are in turn commonly coupled to a longitudinal manifold 64 generally shown and described in connection with FIG. 6. Referring again to FIG. 5, five nozzles are illustrated in the present embodiment corresponding to each of the five waterways 42 of FIG. 3. A first nozzle 66 originates with central manifold 64 at center 38 of bit 36 and spirals outwardly to merge with its corresponding waterway 42. A second nozzle 68 is sequentially positioned next to first nozzle 66 and also originates near center 38 of bit 36 but has its orifice slightly more displaced from center 38 than does nozzle 66. Thus, nozzle 66 provides a more direct and easier path of flow to the fluid from longitudinal manifold 64 than does nozzle 68.

Similarly, a third nozzle 70 is next sequentially placed with respect to first nozzle 66 and second nozzle 68 and communicates with central manifold 64 at center 38 of bit 36 in even a slightly more indirect manner such that the orifice of nozzle 70 is radially displaced from center 38 more than second nozzle 68. A fourth nozzle 72 falls next in the sequential and spiral arrangement of the nozzles and has its orifice even more radially spaced from center 38 than third nozzle 70. The illustration of FIG. 5, in fact, shows that the displacement of the orifice of nozzle 72 is far enough from center 38 that it begins to appear that nozzle 72 is more of a branch of the preceding nozzle than a directly communicating branch with the central orifice of manifold 64 at center 38. However, in fact, each nozzle communicates with the center of manifold 64, but each nozzle communicates more indirectly and distantly than the proceeding nozzle. For example, the final nozzle 74 as shown in FIG. 5 communicates with center 38 of bit 36 so distantly that it substantially appears to be a branch of fourth nozzle 72 which in turn appears as if it were a branch of third nozzle 70. Therefore, it can be readily understood by considering the above remarks in the light of FIG. 5, that each of the nozzles 66–74 provide an escape for fluid from the center 38 of bit 36 with a decreasingly direct route as the spiral arrangement of nozzles unfolds. The most direct route is provided by first nozzle 66 and the least direct by last nozzle 74 with each of the intermediate nozzles 68–72 providing a graduated resistance to fluid flow somewhere therebetween.

FIG. 6 axially shows a perspective view of a mandril 76 used as a mold negative for forming central manifold 64 of bit 36 and for defining the nozzles. As is best illustrated in FIG. 6, the point at which the orifice or beginning of the nozzle is formed and the point of the outlet or end of the nozzle cannot be discretely located but actually refers to regions of transition from large central manifold 64 to individual waterways 42. Nevertheless, outlets 82 of nozzles 66–78 have been referenced in FIGS. 5 and 6 and are arbitrarily defined as that point of each nozzle where the nozzle cross-sectional area equals the cross-sectional area of its corresponding waterway. When considering the internal shape of manifold 64 and nozzles 66–74, it is easier to visualize the complex free form pattern of these nozzles by picturing the mold negative illustrated in FIG. 6 than by attempting to depict and visualize the internal channels and bores which mandril 76 of FIG. 6 will form internally in bit 36.

Referring now to FIG. 6, for the purposes of clarity, each of the segments of the mandril 76 have been designated by the same reference numerals used in FIG. 3 to refer to the positive bores and channels forming the nozzles 66–74 in bit 36. For example, the mandril 76 shows beginning at the right and moving in a spiral counterclockwise direction (since it is the negative of the clockwise spiral formed in the bit face) a first segment 66' corresponding to nozzle 66 followed by sequentially ordered segments 68'–74', each corresponding to nozzles 68–74 respectively. Central manifold 64 within bit 36 similarly corresponds to portion 64' of mandril 76. Mandril 76 is characterised by a necked-down portion, generally referenced by numeral 78, which causes the hydraulic flow within conduit 64 defined by mandril 76 to be directed primarily toward first nozzle 66 corresponding to segment 66'. Necked-down portions 78 so constricts the flow such that the next preferred direction of fluid flow from manifold 64 will be directed toward second nozzle 68 corresponding to segment 68' of mandril 76. Similarly, the free-form cross section of mandril 76, particularly in necked-down portion 78, is such that a conduit formed by mandril 76 has an internal cross section which causes the path of fluid flow to the ordered sequence of nozzles 70, 72 and 74 to be both longer and more restricted as the order of the nozzle increases. Additionally, as seen in FIG. 5, the shape and cross section of waterway 42 corresponding to each nozzle is reached in the area referenced as outlet 82 of each nozzle at an increasing radial distance from center 38 for each nozzle beginning with first nozzle 66 and with the most outwardly radially disposed nozzle being fifth nozzle 74. This relationship is more directly and more easily visualized in FIG. 6 where each segment 66'–74' terminates at an increasing radial distance from longitudinal axis 80 of mandril 76 which axis 80 corresponds to longitudinal axis 48 of bit 36 shown in FIG. 4.

Thus it can now readily be understood that in light of the description of the nozzles in FIGS. 5 and 6 that a significant fraction of the hydraulic fluid in longitudinal manifold 64 will be delivered to the bit face of bit 36 beginning with an innermost radial nozzle 66 and thereafter in lessening amounts by graduated steps in a spiral sequence of radially displaced nozzles 68–74. Since the circumferential area of the bit face expands as the distance from center 38 increases, the additional amounts of fluid delivered at increasing radial distances by the sequence of nozzles 66–78 tend to compensate for the radial expansion of bit face area. Therefore, hydraulic pressure is maintained at a substantially equal magnitude across the entire bit face from its center 38 to its periphery 54. In one embodiment the amount of fluid added by each nozzle is approximately proportional to the increase in bit face area as a function of radial distance.

It can also be further understood that the nozzle arrangement described in connection with FIGS. 5 and 6 cooperatively acts with the arrangement of junk slots, waterways and collectors at the shoulder-to-guage transition of bit 36 as described in connection with FIGS. 3 and 4 to provide a substantially uniform distribution of hydraulic fluid and pressure across the entire bit face beginning at center 38 and through gage 46 of bit 36. For example, on gage 46 waterway 42 is adjacent to junk slot 60 on one side and to gage collectors 56 on the other side. The height and distance of the intervening lands is chosen to equalize fluid flow and pressure distribution from waterway 42 to the adjacent junk slot 60 and gage collectors 56.

The total flow area (TFA) is determined by the distance between the bit face and bore surface. The TFA is maintained approximately equal across the bit face, i.e., at each annular zone as the radius of the annular zone increases. TFA is maintained approximately equal by decreasing the exposure of teeth above their corresponding lands. For example, at the apex and nose, tooth exposure is approximately 2.7 mm (0.105"), on the flank approximately 1.9 mm (0.075") and on the shoulder approximately 1 mm (0.040") for the bit of FIG. 3 with a TFA of approximately 0.40 across the entire bit face up to the shoulder. Other values could be chosen according to the drilling application at hand and size of the bit with tooth exposure chosen to produce an approximately uniform TFA of choice at each point on the bit face. In general, a graduated series of the teeth are provided with a tooth height generally inversely proportional to the radial dispositon of each series from the center of the bit so that TFA is approximately uniform across the bit face.

Many alterations and modifications may be made to the illustrated embodiment as described herein without departing from the spirit and scope of the present invention. For example, the particular spiral configuration shown can be altered to include other spiral shapes; the type of teeth set upon the spiral lands can be configured as single or multiple rows; and other distributions of synthetic diamonds and graduated sizes of natural diamonds in the transition portion of the shoulder and gage than that described in the illustrated embodiment can be used. The height, and width of lands, the depth and width of channels and their relationships, even including of the opening or closing of channels can be altered to effect the desired pressure and flow distribution pattern depending upon empirical results. Portion 58 in FIG. 7 could in some cases be serrated in vertical height rather than of uniform height as illustrated. However, the illustrated embodiment, using uniform land heights or channel depths results in a surprisingly even flow of fluid across the shoulder-to-gage periphery. In fact, spillage from the waterways across lands near the center of the bit and outward fills the collectors sufficiently that near and at the shoulder-to-gage transition all channels are filled with fluid under approximately equal pressure and any functional distinction between a waterway and collector substantially ceases. The illustrated embodiment has been shown only for the purposes of example and clarification and should not be taken as limiting the invention as defined in the following claims.

I claim:

1. In a rotating bit having a bit face and center, and including a plurality of polycrystalline diamond elements, each element having a generally triangular prismatic shape characterized by two opposing triangular end surfaces connected by planar side surfaces, said element disposed on said bit face and extending therefrom, an improvement comprising:

disposition of each said polycrystalline diamond element on said bit face wherein said end surfaces of each said element are disposed at an angle with respect to a radius of said rotary bit so that an edge defined by the intersection of an adjacent end and side surface of said element serves as a leading edge with respect to the direction of travel of said element as said bit rotates about said bit center;

wherein each said polycrystalline diamond element is disposed on said bit face on a raised land having an edge and wherein said end surface of each polycrystalline diamond element is approximately parallel to and substantially adjacent to said edge of said raised land; and wherein said land is disposed on said bit face in a generally spiral pattern whereby said direction of travel of said diamond element is acutely inclined with respect to the longitudinal length of said spirally patterned land, whereby a dihedral leading edge is provided for cutting and fully parallel flow across said end surface adjacent said leading edge is also provided.

2. An improvement in a rotating bit having a bit face and center comprising:

a plurality of lands disposed on said bit face including a pluraity a polycrystalline synthetic diamond cutting elements disposed on said lands;

an internal central manifold within said rotary bit for the conveyance of fluid therethrough;

a plurality of nozzles defined in said bit face communicating with said internal central manifold wherein said plurality of nozzles form an ordered sequence, the first one of said plurality of nozzles of said ordered sequence of nozzles receiving from said central manifold a maximal amount of fluid therefrom with the last one of said plurality of nozzles of said ordered sequence of nozzles receiving from said central manifold a minimal amount of fluid therefrom with each one of said plurality of nozzles of said ordered sequence of nozzles between said first and last one of said ordered sequence of nozzles receiving graduated amounts of fluid from said central manifold, said amounts being graduated in decreasing magnitude from said maximal amount received by said first ordered nozzle to said minimal amount received by said last ordered nozzle to approximately maintain total flow area (TFA) constant across said bit face, said fluid delivered by said nozzles and flowing between said lands whereby an approximately constant amount of fluid is provided to said cutting elements regardless of the location of disposition of said cutting element on said bit face.

3. An improvement in a rotating bit having a bit face and center comprising:

a plurality of lands disposed on said bit face including a plurality of polycrystalline synthetic diamond cutting elements disposed on said lands;

an internal central manifold within said rotary bit for the conveyance of fluid therethrough;

a plurality of nozzles defined in said bit face communicating with said internal central manifold wherein said plurality of nozzles form an ordered sequence, the first one of said plurality of nozzles ordered sequence of nozzles receiving from said central manifold a maximal amount of fluid therefrom with the last one of said plurality of nozzles of said ordered sequence of nozzles receiving from said central manifold a minimal amount of fluid therefrom with each one of said plurality of nozzles of said ordered sequence of nozzles between said first and last one of said ordered sequence of nozzles receiving graduated amounts of fluid from said central manifold, said amounts being graduated in decreasing magnitude from said maximal amount received by said first ordered nozzle to said minimal amount received by said last ordered nozzle to approximately maintain total flow area (TFA) constant across said bit face, said fluid delivered by said nozzles and flowing between said lands whereby an approximately constant amount of fluid is provided to said cutting elements regardless of the location of disposition of said cutting element on said bit face;

wherein said ordered sequence of nozzles are defined in said bit face with said first ordered nozzle defined nearest said center of said rotary bit and said last ordered nozzle defined furtherest away said center of said rotary bit with each one of said plurality of ordered nozzles defined in said bit face at graduated distances between said first and last ordered ones of said nozzles at graduated increments between each nozzle corresponding to said ordered sequence and corresponding to said amount of fluid received from each nozzle from said central manifold.

4. The improvement of claim 7 wherein each nozzle has an outlet, said outlets of said nozzles being defined in said bit face in a spiral pattern wherein said outlet corresponding to said first ordered nozzle is nearest said center of said rotary bit, and each later ordered nozzle having its corresponding outlet defined in said bit face in said spiral pattern at increasing distances from said center of said bit face, said last ordered nozzle having its corresponding outlet defined in said bit face at the furtherest distance away from said center of said bit face as compared to the disposition of said outlets of each of said other ones of said ordered plurality of nozzles.

5. The improvement of claim 3 wherein said amount of fluid delivered by each one of said ordered sequence of nozzles at increasing distances from said center of said rotary bit is approximately proportional to the increment of peripheral area of said bit face as a function of distance from said center of said rotary bit.

6. The improvement of claim 5 wherein said graduated amount of fluid delivered by each nozzle of said ordered sequence of nozzles is controlled by communicating each nozzle with said central manifold through a necked-down portion of said manifold, said graduated amounts being effected in said necked-down portion by arrangement and configuration of said necked-down portions so that said path of fluid flow therethrough is characterized by increasing distance and cross sectional area restriction the further said nozzle is located from said center of said rotary bit face.

7. An improvement in a rotating bit having a bit face and center comprising:

a plurality of lands disposed on said bit face including a plurality of polycrystalline synthetic diamond cutting elements disposed on said lands;

an internal central manifold within said rotary bit for the conveyance of fluid therethrough;

a plurality of nozzles defined in said bit face communicating with said internal central manifold wherein said plurality of nozzles form an ordered sequence, the first one of said plurality of nozzles ordered sequence of nozzles receiving from said central manifold a maximal amount of fluid therefrom with the last one of said plurality of nozzles of said ordered sequence of nozzles receiving from said central manifold a minimal amount of fluid therefrom with each one of said plurality of nozzles of said ordered sequence of nozzles between said first and last one of said ordered sequence of nozzles receiving graduated amounts of fluid from said central manifold, said amounts being graduated in decreasing magnitude from said maximal amount received by said first ordered nozzle to said minimal amount received by said last ordered nozzle to approximately maintain total flow area (TFA) constant across said bit face, said fluid delivered by said nozzles and flowing between said lands whereby an approximately constant amount of fluid is provided to said cutting elements regardless of the location of disposition of said cutting element on said bit face;

wherein said internal central manifold includes a necked-down portion arranged and configured to most directly communicate with said first one of said ordered sequence of nozzles and to less directly communicate in a graduated fashion with each other one of said ordered sequence of nozzles, the last one of said ordered sequence of nozzles being the most indirectly communicated nozzle with said central manifold, wherein graduated communication between said central manifold and each of said plurality of nozzles is effected by constricting the cross sectional area of said necked-down portion of said central manifold communicating with an inlet corresponding to each one of said ordered sequence of nozzles, the largest cross sectional area of said necked-down portion communicating with said inlet of said first one of said ordered sequence of nozzles and said last one of said ordered sequence of nozzles having the smallest cross sectional area of said necked-down portion communicating with said corresponding inlet of said last one of said ordered sequence of nozzles.

8. An improvement in a rotating bit having a bit face and center comprising:

a plurality of lands disposed on said bit face including a plurality of polycrystalline synthetic diamond cutting elements disposed on said lands;

an internal central manifold within said rotary bit for the conveyance of fluid therethrough;

a plurality of nozzles defined in said bit face communicating with said internal central manifold wherein said plurality of nozzles form an ordered sequence, the first one of said plurality of nozzles ordered sequence of nozzles receiving from said central manifold a maximal amount of fluid therefrom with the last one of said plurality of nozzles of said ordered sequence of nozzles receiving from said central manifold a minimal amount of fluid therefrom with each one of said plurality of nozzles of said ordered sequence of nozzles between said first and last one of said ordered sequence of nozzles receiving graduated amounts of fluid from said central manifold, said amounts being graduated in decreasing magnitude from said maximal amount received by said first ordered nozzle to said minimal amount received by said last ordered nozzle to approximately maintain total flow area (TFA) constant across said bit face, said fluid delivered by said nozzles and flowing between said lands whereby an approximately constant amount of fluid is provided to said cutting elements regardless of the location of disposition of said cutting element on said bit face;

wherein said internal central manifold includes a necked-down portion arranged and configured to most directly communicate with said first one of said ordered sequence of nozzles and to less directly communicate in a graduated fashion with each other one of said ordered sequence of nozzles, the last one of said ordered sequence of nozzles being the most indirectly communicated nozzle with said central manifold, wherein graduated communication between said central manifold and said ordered sequence of said nozzles is effected by said necked-down portion of said central manifold by arrangement and configuration of said necked-down portion so that the path of flow of fluid from said central manifold to each said nozzle is characterized by increasing distance and cross sectional area restriction from said first one of said ordered sequence of nozzles to said last one of said ordered sequence of nozzles.

9. An improvement in a rotating bit having a bit face and center, said bit face further including a shoulder, a shoulder-to-gage transition and a gage portion, and including a plurality of waterways, collectors and junk slots defined in said bit face, said improvement comprising:

a plurality of pairs of raised lands defined in said bit face, arranged in a spiral configuration extending from a portion of said bit face near said center of said bit face across said shoulder and to said shoulder-to-gage transition wherein at least two adjacently disposed spirally configured lands are separated by one of said waterways, said one waterway extending to said shoulder-to-gage transition and thence along said gage, one of said lands adjacent to said waterway extending to said shoulder-to-gage transition, said one adjacent land broadening at said shoulder-to-gage transition and forming a plurality of raised connected lands extending along a gage, each one of said plurality of raised lands being separated by one of a plurality of gage collectors on said gage and separated from said waterway by a broadened portion of said one adjacent land, whereby fluid flow through said waterway is evenly distributed and pressure of said fluid is evenly distributed at said shoulder-to-guage transition and along said gage.

10. The improvement of claim 9 wherein said spirally patterned lands on said bit face are paired and connected at their origin near said center of said bit face, said paired lands being separated by a collector, said separating collector extending across said shoulder and said shoulder-to-gage transition to communicate with one of said plurality of junk slots formed in said gage.

11. The improvement of claim 10 wherein said collector communicating with said junk slot is adjacent to said one adjacent land broadening to form said plurality of gage collectors, said one waterway being adjacent to said one adjacent land on the opposing side of said adjacent land from said collector separating paired and connected lands and communicating with said junk slot.

12. The improvement of claim 11 wherein each said collector is also adjacent to a waterway on one side thereof, said adjacent land and plurality of gage collectors being defined in said bit face on the opposing side of said waterway, whereby fluid flow and fluid pressure is evenly distributed across said shoulder-to-gage transition and across said gage including said junk slot, gage collectors and waterway defined on said gage.

13. An improvement in a rotating bit having a bit face and center, said bit face further including a shoulder, a shoulder-to-gage transition and a gage portion, and including a plurality of waterways, collectors and junk slots defined in said bit face, said improvement comprising:

a plurality of pairs of raised lands defined in said bit face, arranged in a spiral configuration extending from a portion of said bit face near said center of said bit face across said shoulder and to said shoulder-to-gage transition wherein at least two adjacently disposed spirally configured lands are separated by one of said waterways, said one waterway extending to said shoulder-to-gage transition and thence along said gage, one of said lands adjacent to said waterway extending to said shoulder-to-gage transition, said one adjacent land broadening at said shoulder-to-gage transition and forming a plurality of raised connected lands extending along a gage, each one of said plurality of raised lands being separated by one of a plurality of gage collectors on said gage and separated from said waterway by a broadened portion of said one adjacent land, said spirally patterned lands defined on said bit face are paired and connected at said center of said bit face, one of said plurality of collectors defined between said paired and connected lands, and wherein said waterway is defined between adjacent pairs of said lands, said rotary bit including nozzles defined in said bit face provided with fluid, said waterway directly communicating with one of said nozzles, whereby fluid flow through said water is evenly distributed and pressure of said fluid is evenly distributed at said shoulder-to-gage transition and along said gage.

14. In a rotating bit having a center, a bit face and gage for said bit for drilling a bore, an improvement comprising:

a plurality of cutting teeth disposed on said bit and extending above said bit face, the amount of extension of said plurality of teeth above said bit face defining at each location a clearance between said bit face and said bore drilled by said bit, said plurality of teeth having a graduated height above said bit face beginning at a maximum near said center of said bit and decreasing toward the gage of said bit, the height of said plurality of teeth extending above said face of said bit being approximately inversely proportional to the radial distance of said tooth from said center of said bit, whereby the total flow area (TFA) of said bit is approximately uniform across the face of said bit.

15. The improvement of claim 14 wherein said plurality of teeth are grouped into a series of sets, each set of teeth characterized by one of a plurality of graduated heights so that said height of said sets decreases from said center of said bit to said gage in a stepwise fashion approximately inversely proportional to the average radial distance of said set of teeth from said center in order to approximately keep total flow area (TFA) constant.

* * * * *